US009623695B2

(12) United States Patent
Fejfar

(10) Patent No.: US 9,623,695 B2
(45) Date of Patent: Apr. 18, 2017

(54) METHOD FOR PRINTING ON A SUBSTRATE

(71) Applicant: manroland web systems GmbH, Augsburg (DE)

(72) Inventor: Florian Fejfar, Munich (DE)

(73) Assignee: manroland web systems GmbH, Augsburg (DE)

( * ) Notice: Subject to any disclaimer, the term of this patent is extended or adjusted under 35 U.S.C. 154(b) by 0 days.

(21) Appl. No.: 14/477,505

(22) Filed: Sep. 4, 2014

(65) Prior Publication Data

US 2015/0068418 A1 Mar. 12, 2015

(30) Foreign Application Priority Data

Sep. 10, 2013 (DE) ..... 10 2013 109 920

(51) Int. Cl.
*B41F 33/00* (2006.01)
*B41M 5/00* (2006.01)
*B41J 29/393* (2006.01)

(52) U.S. Cl.
CPC ..... *B41M 5/0023* (2013.01); *B41F 33/0036* (2013.01); *B41F 33/0081* (2013.01); *B41J 2029/3935* (2013.01); *B41P 2233/50* (2013.01); *B41P 2233/51* (2013.01); *B41P 2233/52* (2013.01)

(58) Field of Classification Search
None
See application file for complete search history.

(56) References Cited

U.S. PATENT DOCUMENTS

| | | | | |
|---|---|---|---|---|
| 3,890,048 | A * | 6/1975 | Abbondio et al. | 101/335 |
| 4,310,248 | A * | 1/1982 | Meredith | 356/402 |
| 4,878,753 | A * | 11/1989 | Nestmeier | 101/485 |
| 4,901,254 | A * | 2/1990 | Dolezalek et al. | 356/405 |
| 5,181,257 | A * | 1/1993 | Steiner et al. | 101/486 |
| 5,696,890 | A * | 12/1997 | Geissler et al. | 358/1.9 |
| 6,446,555 | B1 * | 9/2002 | Schramm et al. | 101/365 |

(Continued)

FOREIGN PATENT DOCUMENTS

| | | |
|---|---|---|
| DE | 40 31 423 A1 | 4/1991 |
| DE | 196 39 014 A1 | 4/1998 |

(Continued)

OTHER PUBLICATIONS

European Search Report issued in corresponding European Application No. 14180737.0 dated Jul. 15, 2015, with Statement of Relevancy (Nine (9) pages).

*Primary Examiner* — Jill Culler
(74) *Attorney, Agent, or Firm* — Crowell & Moring LLP

(57) ABSTRACT

A method for printing on a substrate is disclosed. In an embodiment of the method, the method includes printing a small print control mark of a printed color in a print zone of the substrate and printing a large print control mark of the printed color in the print zone of the substrate. A measurement value of the small print control mark and a measurement value of the large print control mark is detected by a sensor. A deviation between the measurement value of the small print control mark and the measurement value of the large print control mark is determined and an actual value of a print parameter of the printed color is corrected based on the deviation.

15 Claims, 1 Drawing Sheet

(56) References Cited

U.S. PATENT DOCUMENTS

| | | | | |
|---|---|---|---|---|
| 6,796,240 | B2 * | 9/2004 | Sainio et al. | 101/485 |
| 7,219,606 | B2 * | 5/2007 | Mindrup | 101/484 |
| 7,481,165 | B2 * | 1/2009 | Weichmann | 101/484 |

FOREIGN PATENT DOCUMENTS

| | | | |
|---|---|---|---|
| DE | 10 2007 059 842 | A1 | 6/2009 |
| WO | WO 2010/071543 | A1 | 6/2010 |

* cited by examiner

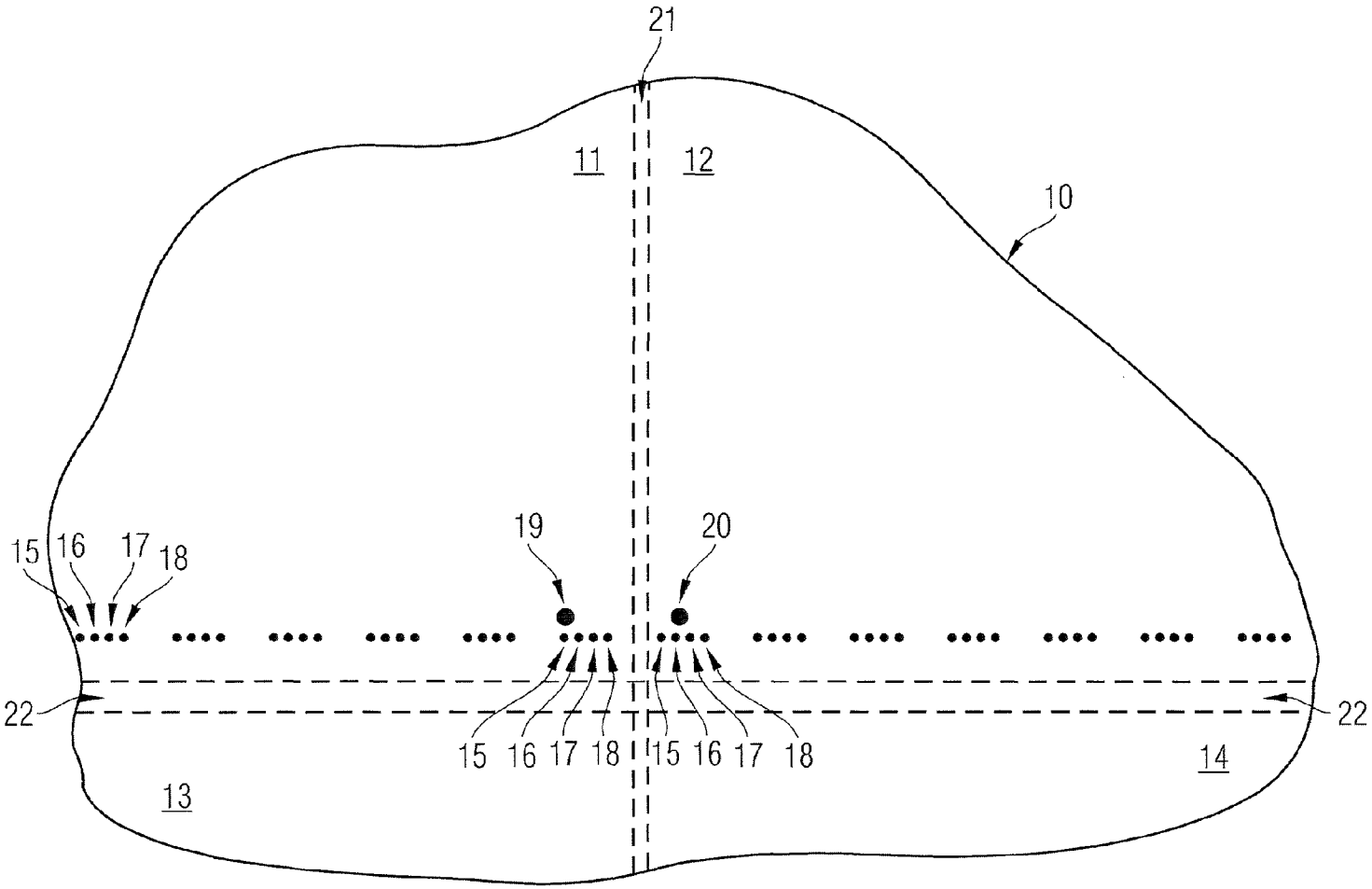
10
11
12
13
14
15
16
17
18
19
20
21
22

METHOD FOR PRINTING ON A SUBSTRATE

This application claims the priority of German Patent Document No. DE 10 2013 109 920.3, filed Sep. 10, 2013, the disclosure of which is expressly incorporated by reference herein.

BACKGROUND AND SUMMARY OF THE INVENTION

The invention relates to a method for printing on a substrate.

The control of print-related processes, such as for example a color register control or a color density control, usually takes place using print control marks printed on a substrate, which are measured with the help of sensors, wherein actual values of the print control marks determined in the process are compared with set point values for the print control marks in order to determine adjusting signals for the print-related process to be controlled based on a deviation between the actual values and the set point values. Such print control marks are typically printed on the substrate outside the actual print image or subject. Since such print control marks are perceived objectionable, smaller print control marks are increasingly employed which can have a diameter between 0.2 mm and 0.3 mm. These small print control marks, in addition to the round shape, can also have a rectangular, square or any polygonal or another shape, wherein these as a rule have an area of approximately 0.03 $mm^2$ to approximately 0.07 $mm^2$. Such small print control marks are also called micromarks. In particular when such small print control marks for controlling a print-related process are used, there is the problem that the actual values which are detected on such small print control marks can be affected by a major measurement inaccuracy or a major measurement error because of heavy stray light influences. For this reason, detecting utilizable actual values on such small print control marks, which can be utilized for a stable control of a print-related process, poses difficulties. Starting out from this, the present invention is based on the object of creating a new type of method for printing on a substrate.

According to the invention, at least one relatively small print control mark is printed in at least one printing zone of the substrate. In at least one printing zone of the substrate, at least one relatively large print control mark is additionally printed. The or each relatively small print control mark and the or each relatively large print control mark are detected with the help of a sensor. With the help of the measurement value of the or each relatively large print control mark, the actual values of print parameters detected through measurement of the relatively small print control marks are corrected. With the present invention it is provided, in addition to the at least one relatively small print control mark printed on the substrate, to print at least one relatively large print control mark on the substrate in order to correct the actual values of the print parameters detected on the relatively small print control marks based on a measurement value detected on the or each relatively large print control mark. A correction of actual values of the print parameters obtained on relative small print control marks is thus dynamically possible in the printing process, so that actual values obtained on such relatively small print control marks are also stable and reliable and can thus be utilized for controlling a print-related process with high control quality.

According to an advantageous further development of the invention, a relatively small print control mark is printed in at least one printing zone, namely in at least one color zone, of the substrate for all printed printing colors each, wherein for at least one printed printing color in at least one of the color zones a relatively large print control mark is printed, wherein the relatively small print control mark printed in the same color zone for the same print color and relatively large print control marks are detected with the help of the same sensor, and wherein based on the deviation between the measurement values of the relatively small print control mark and relatively large print control mark printed in the same color zone for the same print color the actual values of the print parameters detected in all color zones through measurement of the relatively small print control marks are corrected.

Preferentially, a relatively large print control mark is printed for each printed printing color in at least one of the color zones in each case, wherein the relatively small print control mark and relatively large print control mark printed in the same color zone for the same printing color are detected with the help of the same sensor, and wherein based on the deviation between the measurement values of the relatively small print control mark and relatively large print control mark printed in the same color zone for the same printing color, the actual values detected in all color zones for the same printing color through measurement of the relatively small print control marks are corrected. In particular when for each printing color a relatively large print control mark is printed on the substrate in addition to the relatively small print control marks, a particularly advantageous color density control and color register control is possible.

Preferentially, the relatively large print control mark of a printing color is printed onto the substrate in the immediate vicinity of a relatively small print control mark for the same printing color. In this way this ensures that the measurement values detected on the relatively large print control mark and on the relatively small print control mark are detected under identical measurement conditions, so that an advantageous correction of the actual values of the print parameters detected on the relatively small print control marks can then take place.

Preferred further developments of the invention are obtained from the subclaims and the following description. An exemplary embodiment of the invention is explained in more detail with the help of the drawing without being restricted to this.

BRIEF DESCRIPTION OF THE DRAWING

FIG. 1 is a detail of a printed substrate according to the principles of the present invention.

DETAILED DESCRIPTION OF THE DRAWING

The present invention relates to a method for printing on a substrate.

On a substrate to be printed, at least one print image is printed on the one hand and at least one print control mark in at least one printing zone of the substrate. The print control marks are detected by measurement with the help of a sensor in order to detect actual values of print parameters on the same.

With respect to the employed sensors, different configurations can be realized. Accordingly, the relatively small and the relatively large print control marks can be detected with one and the same sensor. There is furthermore also the possibility of detecting the relatively small and the relatively large print control marks with separate sensors.

In addition to this, different sensor arrangements are known from the prior art. In a configuration, at least one sensor is arranged moveable across the substrate width so that the print control marks across the substrate width are detected offset in time by moving the sensor transversely to the printing direction. In another configuration, a plurality of sensors are arranged across the web width so that over the entire substrate width the marks can be detected across the entire substrate width at the same time or only minimally offset in time. Although this configuration requires a multitude of sensors, it however makes possible substantial shorter detection cycles. As a third form, a combination of both variants can be realized, in the case of which multiple sensors are moveably arranged across the substrate width so that the movement distances and thus the detection cycles can be reduced.

The actual values are compared with corresponding set point values, wherein dependent on deviations between the actual values and the set point values the printing of the substrate is controlled in such a manner that the deviations between the actual values and the set point values are smaller than limit values and that the actual values thus approximate the set point values or follow the same.

FIG. 1 shows a detail of a substrate 10, which preferentially is a web-shaped substrate printed in a reel-fed printing press. On the web-shaped substrate 10, multiple print pages 11, 12, 13 and 14 are printed in FIG. 1, wherein the print regions of the print pages 11, 12, 13 and 14 are separated by interrupted lines.

In FIG. 1, a substrate region 21 is formed between the print pages 11 and 12, which based on cylinders involved in the printing are printed on the substrate 10 seen in the axial direction next to one another, in which the substrate 10 is not printed and which typically serves for forming a fold between print pages 11 and 12. Between the print pages 11 and 13, as well as 12 and 14, which are printed on the substrate 10 based on the cylinders involved in the printing seen in the circumferential direction of the same one behind the other, a print-free region 22 is likewise formed, in the region of which the substrate 10 is typically trimmed during the cutting of signatures.

On the substrate 10, a print image each is printed in FIG. 1 in the region of each print page 11, 12, 13 and 14. Seen in the axial direction, the substrate in this case is printed in multiple printing zones, namely color zones, wherein the individual printing zones or color zones of the substrate 10 are not drawn in in FIG. 1. The axial width of the printing zones or color zones is obtained through the axial width of color zone adjusting elements, which are installed in the region of the inking couples of printing couples of a printing press involved in the printing.

From FIG. 1 it is evident that preferentially multiple relatively small print control marks 15, 16, 17, 18 are printed in each printing zone or color zone of the substrate, wherein for preferentially each printing color involved in the printing a relatively small print control mark 15, 16, 17, 18 each is printed in each of the printing zones or color zones of the substrate. In FIG. 1, four relatively small print control marks 15, 16, 17, 18 are printed in the respective printing zone for each printing zone, namely for the printing colors of cyan, magenta, yellow and black involved in the printing.

These relatively small print control marks 15, 16, 17, 18 which are printed for each print color involved in the printing in each case in each of the color zones of the printed substrate 10 are so-called micromarks, which typically have a diameter between 0.2 mm and 0.3 mm. In addition to the round shape, these small print control marks can also have a rectangular, square or any polygonal or other shape, wherein these as a rule have an area of approximately 0.03 $mm^2$ to approximately 0.07 $mm^2$. On such micromarks, the detecting of actual values for print parameters, such as for example detecting actual values of a color density measurement, can be subjected to major error as a result of stray light influences.

In terms of the invention, at least one relatively large print control mark 19, 20 is additionally printed in at least one printing zone or color zone of the substrate in addition to the relatively small print control marks 15, 16, 17, 18 printed on the substrate 10 preferentially in each printing zone or color zone. The relatively large print control marks 19, 20 can be called macromarks. The area of these large print control marks 19, 20 as a rule corresponds to at least 1.5 times, preferentially 3 to 4-times the area of the small print control marks 15, 16, 17, 18, so that these have an area that is larger or equal to 0.045 $mm^2$, preferentially 0.09 $mm^2$ to approximately 0.3 $mm^2$ and can, with respect to their configuration, have any shape, preferentially a round, rectangular or any polygonal shape.

The size of the relatively large print control marks 19, 20 or of the macromarks is thus dimensioned in such a manner that on the same more accurate measurement values can be detected than on the relatively small print control marks or on the micromarks, i.e., measurement values which are less severely impaired, for example, through stray light effects.

In the printing process, the relatively small print control marks 15, 16, 17 and 18 which are printed onto the substrate in at least one, preferentially into each print zone, and the or each relatively large print control mark 19, 20 are detected with the help of a sensor, wherein with the help of the measurement value of the or each relatively large print control mark 19, 20 the actual values of the print parameters detected on the relatively small print control marks 15, 16, 17 and 18 are automatically corrected. Accordingly, in the printing process, an automatic correction and thus a dynamic calibration of the actual values of the respective print parameters detected on the relatively small control marks 15, 16, 17 and 18 takes place.

In FIG. 1, a relatively small print control mark 15, 16, 17 and 18 is printed onto the substrate 10 in each print zone, namely in each color zone of the substrate for all print colors involved in the printing. For at least one printed print color, a relatively large print control mark 19, 20 is additionally printed into one of the print zones or color zones. Accordingly, FIG. 1 shows that in the specific print zone or color zone of the substrate which in the print page 11 is positioned on the very right and in the specific print zone or color zone of the substrate, which in the print page 12 is positioned on the very left, a relatively large print control mark 19, 20 is printed, wherein in FIG. 1 the print control mark 19 in the color zone or print zone on the very right of the print page 11 is printed directly above a relatively small print control mark 15 for the print color cyan and in the very left print zone or color zone of the print page 12, the relative large print control mark 20 printed there is printed directly above the relatively small print control mark 16 for the print color magenta on the substrate 10.

In the print zone or color zone of the substrate 10, in which the print control marks 15 and 19 are printed directly on top of one another, and in the print zone or color zone of the substrate 10, in which the print control marks 16 and 20 are printed directly on top of one another, the respective print control marks are detected by measurement with the help of the same sensor.

Here, in FIG. 1, on the print zone or color zone for the print color cyan in the print page 11 on the very right a measurement value is detected on the relatively small print control mark 15 and a measurement value on the relatively large print control mark 19, wherein based on the deviation between these two measurement values for the print color cyan the actual values for the print color cyan are automatically corrected in all color zones through measurement of the relatively small print control marks 15.

In the print page 12, on the print zone or color zone on the very left a measurement value each for the print color magenta is determined on the relatively small print control mark 16 for the print color magenta and on the relatively large print control mark 20 for the print color magenta, wherein a deviation between these two measurement values is determined and wherein furthermore based on this deviation the actual values, which are determined in color zones on the relatively small print control marks 16 of the print color magenta are automatically corrected.

Preferentially, a relatively large print control mark for each print color involved in the printing is printed in one of the color zones or print zones of the substrate 10, namely preferentially in the immediate vicinity of a relatively small print control mark printed for the same print color, wherein based on the deviations between the measurement values detected on these print control marks the actual values which are detected in all color zones on the relatively small print control marks for the same print color are then corrected.

In terms of the present invention, at least one relatively large print control mark is accordingly printed for each print color in one of the print zones or color zones on the substrate 10 in addition to the relatively small print control marks, which are printed in at least one, preferentially in each print zone or color zone of the substrate 10, preferentially in the immediate vicinity of the relatively small print control mark printed in the respective print zone or color zone for the same print color.

The two print control marks of different size for the same print color are measured with the help of the same sensor in order to detect on the same measurement values each for the respective print color. Based on the deviation between these measurement values, automatic correction and thus automatic calibration for the actual values of the print parameters detected on all relatively small print control marks of the color zones or print zones takes place. Because of this it is possible to compensate measurement errors, which can occur on relatively small print control marks for example as a consequence of stray light effects. Thus, relatively small print control marks can also be utilized with the invention for a high-quality control of a printing process, for example for a high-quality color density control and/or color register control.

As already explained, the arrangement of the relatively large print control marks preferentially takes place in the immediate vicinity of a relatively small control mark printed for the same print control mark. Preferentially, the relatively large print control marks are placed into such regions of the substrate 10 in which, in a print further processing, a fold or collar is formed, or in which, in a print further processing, the trimming of the substrate takes place.

Detecting the print control marks can take place in the form that as an alternative to the detecting of the individual relatively small and relatively large print control marks with a sensor, a detecting of mark clusters by a sensor is also possible. Here, multiple print control marks of a print zone, preferentially of a color zone or multiple print control marks in multiple print zones, preferentially color zones are combined into a mark cluster and jointly detected.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for printing on a substrate, comprising the steps of:

printing a small print control mark in a printing zone of the substrate;

printing a large print control mark in the printing zone of the substrate;

detecting the small print control mark and the large print control mark by a sensor;

obtaining an actual print parameter value detected on the small print control mark and a measurement value detected on the large print control mark;

using the measurement value detected on the large print control mark, correcting the actual print parameter value detected on the small print control mark to provide a corrected actual print parameter value on the small print control mark; and utilizing the corrected actual print parameter value on the small print control mark for controlling a printing process on the substrate.

2. The method according to claim 1, wherein the small print control mark is one of a plurality of small print control marks of a printed color in a plurality of printing zones of the substrate, the large print control mark is one of a plurality of large print control marks of the printed color in at least one of the plurality of printing zones, and a number of the plurality of printing zones with small print control marks is greater than a number of the printing zones with large print control marks.

3. The method according to claim 1, wherein, in multiple printing zones of the substrate, a small print control mark is printed for all printed colors for at least one of the printed colors in at least one of the multiple printing zones, a large print control mark is printed, and a number of the printing zones with small print control marks is greater than a number of the printing zones with large print control marks.

4. The method according to claim 1, wherein, in each printing zone of the substrate for all printed colors at least one small print control mark is printed and, for at least one of the printed colors in at least one of the printing zones, at least one large print control mark is printed.

5. The method according to claim 1, wherein a large print control mark is printed for all printed colors in the printing zone.

6. The method according to claim 1, wherein an actual value of a print parameter of the printed color of a small print control mark in a second printing zone is corrected based on the corrected actual print parameter value.

7. The method according to claim 1, wherein the actual print parameter value detected on the small print control mark and the measurement value detected on the large print control mark are detected by separate sensors.

8. The method according to claim 1, wherein the large print control mark is printed on the substrate in an immediate vicinity of the small print control mark.

9. The method according to claim 8, wherein the small print control mark and the large print control mark are orientated along a line that runs parallel or approximately parallel to a printing direction.

10. The method according to claim 1, wherein the large print control mark is printed in a region of the substrate in which a fold or a collar is formed or which is removed for trimming the substrate.

11. The method according to claim 1, wherein the sensor is moveably arranged transversely to a printing direction and wherein the small print control mark and the large print control mark are detected offset in time.

12. The method according to claim 1, wherein, across the substrate width, multiple sensors are arranged, and the small print control mark and the large print control mark are detected at a same time or almost at the same time.

13. The method according to claim 1, wherein clusters of small print control marks and large print control marks are detected.

14. The method according to claim 1, wherein an area of the large print control mark corresponds to at least 1.5 times an area of the small print control mark.

15. The method according to claim 1, wherein the area of the large print control mark corresponds to 3 to 4 times the area of the small print control mark.

* * * * *